US006105827A

United States Patent [19]

Rowan

[11] Patent Number: 6,105,827

[45] Date of Patent: Aug. 22, 2000

[54] BEVERAGE DISPENSING HELMET APPARATUS

[76] Inventor: Jason Rowan, 77 Finch Avenue East, Apt. 146, Toronto, Ontario, Canada, M2N 6H8

[21] Appl. No.: 09/304,682

[22] Filed: May 4, 1999

[51] Int. Cl.[7] ..... B67D 5/64

[52] U.S. Cl. ..... 222/175; 2/422; 224/148

[58] Field of Search ..... 222/175, 144.5, 222/132, 129.1, 78, 129, 349; 2/422; 224/148

[56] References Cited

U.S. PATENT DOCUMENTS

| | | | |
|---|---|---|---|
| 3,260,462 | 7/1966 | Smaczny | 239/33 |
| 4,681,244 | 7/1987 | Geddie | 222/144.5 |
| 4,739,905 | 4/1988 | Nelson | 222/145 |
| 4,813,083 | 3/1989 | Davidson | 2/422 |
| 5,070,546 | 12/1991 | Stazo et al. | 2/199 |
| 5,850,639 | 12/1998 | Arita et al. | 4/388 |

*Primary Examiner*—Kevin Shaver
*Assistant Examiner*—M A. Cartagena
*Attorney, Agent, or Firm*—Eugene J. A. Gierczak

[57] ABSTRACT

A beverage dispensing device having a helmet shell, elevated reservoir for holding a beverage mounted on the helmet shell and valve mechanism, where the valve mechanism is engaged by a user to create a downward flow of the beverage whereby the beverage is dispensed to the mouth of the user through an outlet tube.

9 Claims, 4 Drawing Sheets

BEVERAGE DISPENSING HELMET APPARATUS

FIELD OF INVENTION

This invention generally relates to a beverage dispensing helmet structure for dispensing fluid into the mouth of a user. More particularly, this invention relates to a helmet structure comprising an elevated reservoir and outlet tube for creating a descending flow of fluid through said outlet tube to the mouth of the user.

BACKGROUND OF INVENTION

A number of arrangements have been proposed to allow transport of, and ready access to, a volume of fluid by providing a reservoir which may be mounted on a user's head and means for dispensing fluid from said reservoir.

For example, U.S. Pat. No. 4,681,244 issued to John D. Geddie on Jul. 21, 1987 provides for a portable mix bar comprising a hard hat having a plurality of drink containers and a pair of mixing chambers for mixing drinks mounted thereon, wherein a flow of drinks to and from the mixing chambers is controlled by a plurality of tubes for carrying drinks from the drink containers to the valves and mixing chambers and between valves and mixing chambers and from the mixing chambers to the mouth of a user. Each of said tubes is adapted to serve as a suction tube for sucking liquid to achieve movement of fluid.

Further, U.S. Pat. No. 5,184,950 issued to Dave K. Hosaka on Sep. 22, 1992, provides a helmet and fluid reservoir apparatus, comprising: (a) a helmet shell, the helmet shell including a lower continuous edge, and the helmet shell further including a forward shell opening directed through the helmet shell, and a fibrous liner mounted within the helmet shell at least between the shell opening and the lower edge, and (b) a flexible fluid reservoir pouch mounted to the fibrous liner between the lower edge and the forward shell opening, the flexible reservoir pouch including a right flexible fluid container and a left fluid flexible container longitudinally aligned relative to one another and hingedly mounted relative to one another about a central conduit, (c) the right fluid container and the left fluid container each including a respective right and left first hook and loop fastener patch for securement to the fibrous liner and (d) the central conduit including an "L" shaped drinking conduit projecting above the central conduit in fluid communication with the central conduit, the central conduit in fluid communication with the right and left fluid cavity.

U.S. Pat. No. 5,340,006 issued to Tianhou Li on Aug. 23, 1994, provides a head-supported drink holder apparatus for supporting a beverage receptacle at a selected position generally horizontal distance from a user's mouth; wherein, the apparatus comprises: (a) a pair of head engaging support units where each support unit comprises a support member having a generally right L-shaped lower portion, including a leg element and a foot element, wherein each foot element is provided with an elongated aperture provided with a plurality of recesses; (b) strap means for securing the support members of the user's head; and (c) a beverage receptacle holder unit including an inner ring element dimensioned to receive a beverage receptacle and having a first axle element and an outer ring element dimensioned to receive said first axle element of the inner ring element and provided with a second axle element disposed generally perpendicular to said first axle elements, wherein said second axle element is dimensioned to be received in opposed recesses in said support members.

The known fluid dispensing means providing a reservoir which may be mounted on a user's head require that the user create suction with his/her mouth in order to dispense fluid through a suction tube. The improved beverage dispensing device disclosed herein provides structure for a downward flow of a fluid from an elevated reservoir associated with a helmet structure and an outlet tube for ingesting the fluid in a user's mouth. The use of gravitational force rather than user-generated suction to dispense liquid from such a head-supported dispensing device permits a continuous volume of liquid to be dispensed than would be possible using suction generated by a user.

Also, in the case of a user who is short of breath due to having engaged in physical activity, for example, generating suction sufficient to dispense the desired volume of liquid may not only be cumbersome but would negatively affect blood oxygenation and therefore physical performance.

Alternatives to the structure disclosed herein which achieve the benefit of dispensing significant volumes of liquid at a relatively fast or continuous rate but without the need for user-generated suction might include structures providing a pumping means to pump liquid from a reservoir to a user's mouth or means for pressurizing a liquid so as to permit liquid to be dispensed once a valve is engaged. Such structures, however, would be by nature more complicated and more expensive to produce than the device disclosed herein.

The invention disclosed herein therefore provides means for a fluid dispensing device to be supported by a user's head which dispenses significant volumes of liquid which is easy to use and inexpensive to produce.

BRIEF DESCRIPTION OF DRAWINGS

A detailed description of the preferred embodiments are provided herein below, by way of example only, with reference to the following drawings, in which.

Figure 1:
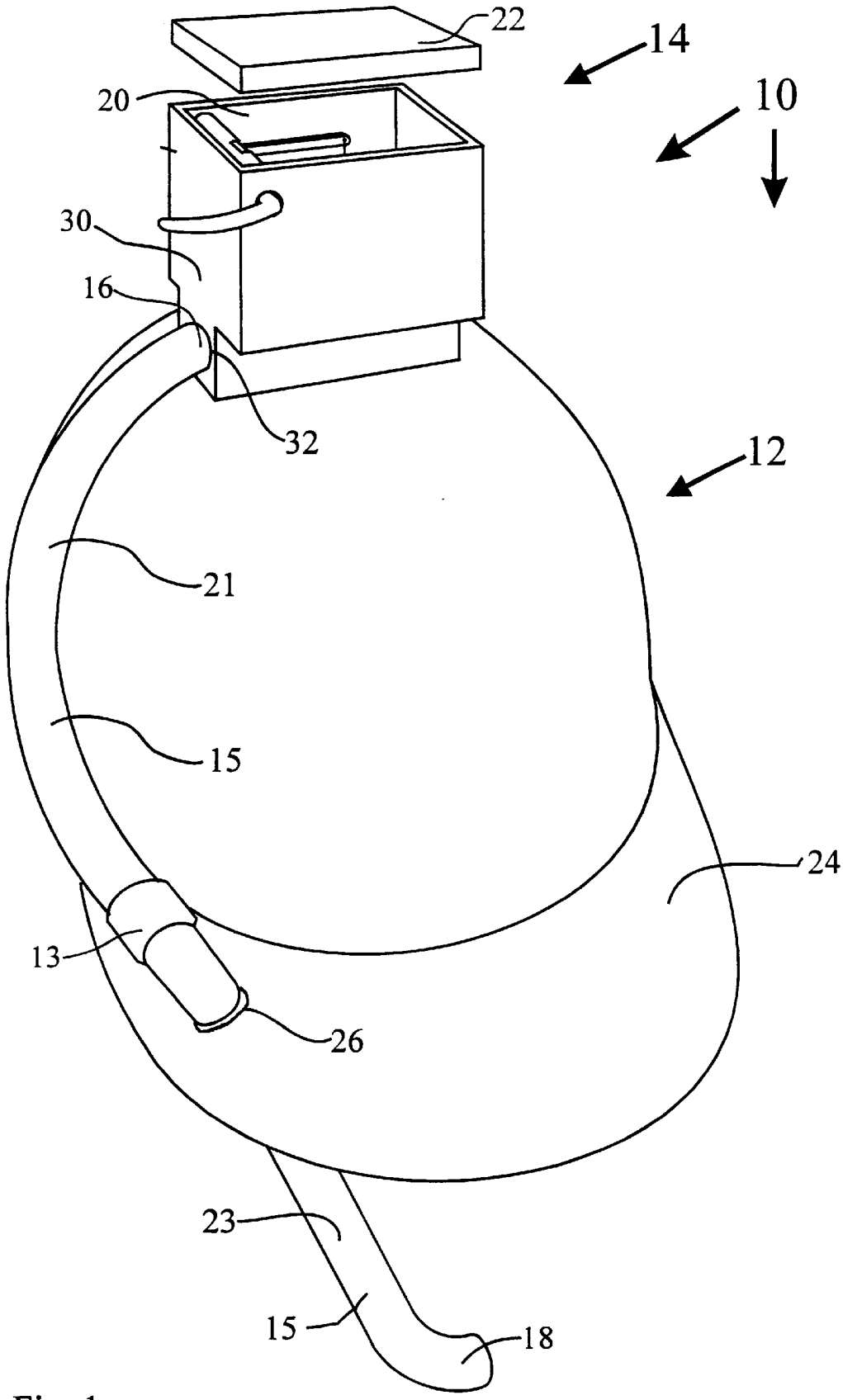
FIG. 1 is a front perspective view of a first preferred embodiment of the invention described herein.

In the drawings, preferred embodiments of the invention are illustrated by way of example. It is expressly understood that the description and the drawings are only for the purpose of illustration and as an aid to understanding and are not intended as a definition of the limits of the invention.

BEST MODE FOR CARRYING OUT THE INVENTION

In the description which follows, like parts are marked throughout the specification and the drawings with the same respective reference numerals. The drawings are not necessarily to scale and in some instances proportions may have been exaggerated in order to more clearly depict certain features of the invention.

Now referring to FIG. 1, the first preferred embodiment of the beverage dispensing means 10 is shown. Said beverage dispensing means 10 comprises a helmet shell 12, elevated reservoir 14 mounted on said helmet shell 12, and outlet tube 15. Outlet tube 15 comprises a first receiving end 16 for receiving fluid from said elevated reservoir 14 from which said fluid flows downwardly toward second dispensing end 18 so as to dispense said fluid into the mouth of a user.

It should be understood that helmet shell 12 may comprise moulded plastic, fibreglass, wood, metal or other materials. Similarly, elevated reservoir 14 may also comprise moulded plastic, fibreglass, wood, metal or other materials.

Elevated reservoir 14 and helmet shell 12 may be fashioned from any number of materials as a single unit from the same material, in a manner well-known to those skilled in the art. Alternatively, elevated reservoir 14 and helmet shell 12 may comprise two separate units, each of which is fashioned from one or more of said materials.

Elevated reservoir 14 may also comprise a transparent material, such as a transparent plastic so as to permit a visual check to see how much water is contained in said elevated reservoir 14. Said transparent elevated reservoir 14 may be further furnished with volume identification markings for indicating a liquid volume within said elevated reservoir tube 14 by visual alignment of the meniscus of a column of liquid within said elevated reservoir 14 with said identification markings.

Where the fluid dispensing device comprises said two separate parts, elevated reservoir 14 is mounted on helmet shell 12 in an elevated position with respect to second dispensing end 18 by using an adhesive, nuts and bolts or the like.

It should also be understood, that without departing from the invention described herein, elevated reservoir 14 may also be presented by helmet shell 12, by providing said helmet shell 12 with a fluid cavity adjacent to the top portion of said helmet shell 12.

Further referring to FIG. 1, means are provided for introducing a fluid into elevated reservoir 14. In the first preferred embodiment of the invention illustrated in FIG. 1, elevated reservoir 14 is provided with a top opening 20. Said top opening 20 communicated with cover 22 for covering said top opening 20 once said fluid is introduced into elevated reservoir 14, so as to prevent spillage of liquid from said elevated reservoir 14.

In the first preferred embodiment of the invention described herein, cover 22 comprises a flexible yet resilient plastic, and said cover 22 has an inner cross-section which is marginally less than the outer cross-section of said elevated reservoir 14.

Alternate means for introducing a fluid into said elevated reservoir 14 can be provided without departing from the spirit of the invention. For example, said elevated reservoir 14 may be presented with a top wall having an opening (not shown) which communicates with a funnel (not shown) which is mounted on said top wall, wherein said opening may be sufficiently small so as to prevent significant spillage of liquid from said opening once said elevated reservoir 14 has been filled, while allowing said elevated reservoir 14 to be filled in co-operation with the funnel. Alternatively, the top wall of said elevated reservoir 14 may be presented with a larger opening for pouring a liquid into said elevated reservoir 14 and cap for sealing (with the appropriate vent holes to permit flow of liquid through outlet tube 15) said opening once said elevated reservoir 14 has been filled to prevent spillage.

It is desirable that the portion of said outlet tube 15 adjacent to said second dispensing end 18 comprise a flexible material, so as to permit a user to modify the orientation of said portion of said outlet tube 15 adjacent to said second dispensing end 18 so that said outlet tube 15 communicates with the user's mouth to dispense said fluid therein. Either said outlet tube 15 comprises entirely a flexible material such as a plastic, or as in the preferred embodiment illustrated in FIG. 1, said outlet tube 15 further comprises a first rigid portion 21, and second flexible portion 23.

Also, in the first preferred embodiment of the invention illustrated herein, as seen in FIG. 1, said helmet shell 12 comprises a visor portion 24. Said visor portion 24 further comprises an opening 26 which communicates with said outlet tube 15.

Said elevated reservoir 14 further comprises a side wall 30 and outlet aperture 32 disposed toward the bottom of said side wall 30. The circumference of said outlet aperture 32 is marginally smaller than the outer circumference of said outlet tube 15, whereby said outlet tube is received frictionally by said outlet aperture 32.

Figure 4:
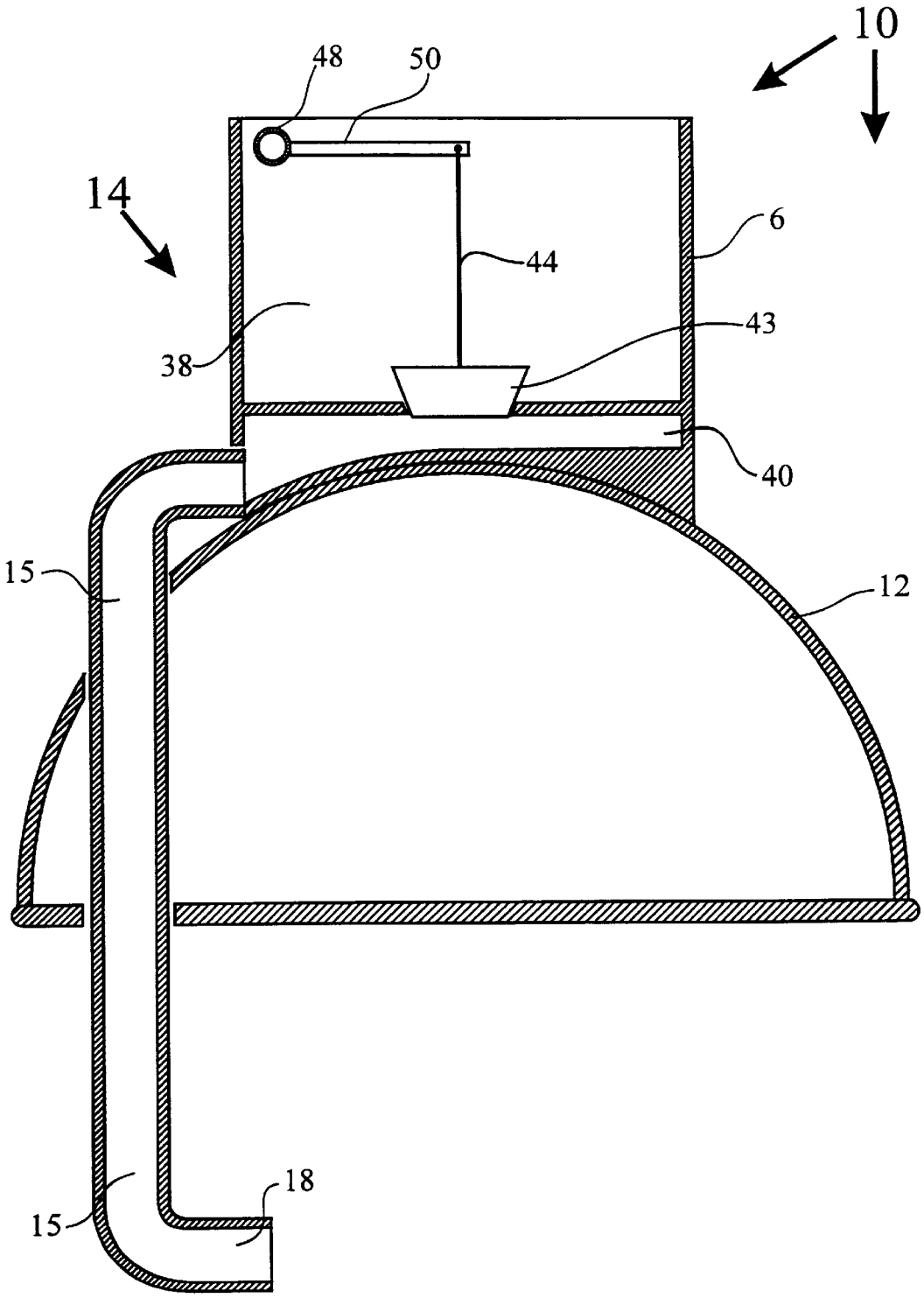
FIG. 4 is a cross-sectional view of the first preferred embodiment of the invention described herein, along line a-a, as shown in FIG. 2.

It is desirable to prevent said outlet tube 15 from being removed from said outlet aperture 32. To this end, an adhesive and/or sealant may be applied around said outlet tube 15 adjacent to said outlet aperture 32, in a manner well-known to those with ordinary skill in the art. In this regard, it will be appreciated that FIG. 4 will include a sealing means in the vicinity of tube 15 and side wall 30. Alternatively, a portion of said outlet tube 15 may be presented inside said elevated reservoir 14 to which portion for example, by mounting a blocking means (not shown) comprising an o-ring and side wall on said portion of said outlet tube 15 presented inside said elevated reservoir 14 by means of screws which communicate with apertures presented by said side wall, which screws are forced into the wall of said outlet tube 15. As the outer circumference of said o-ring is greater than the circumference of said outlet aperture 32, said blocking means prevents removal of said outlet tube 15 from said elevated reservoir 14.

Figure 2:
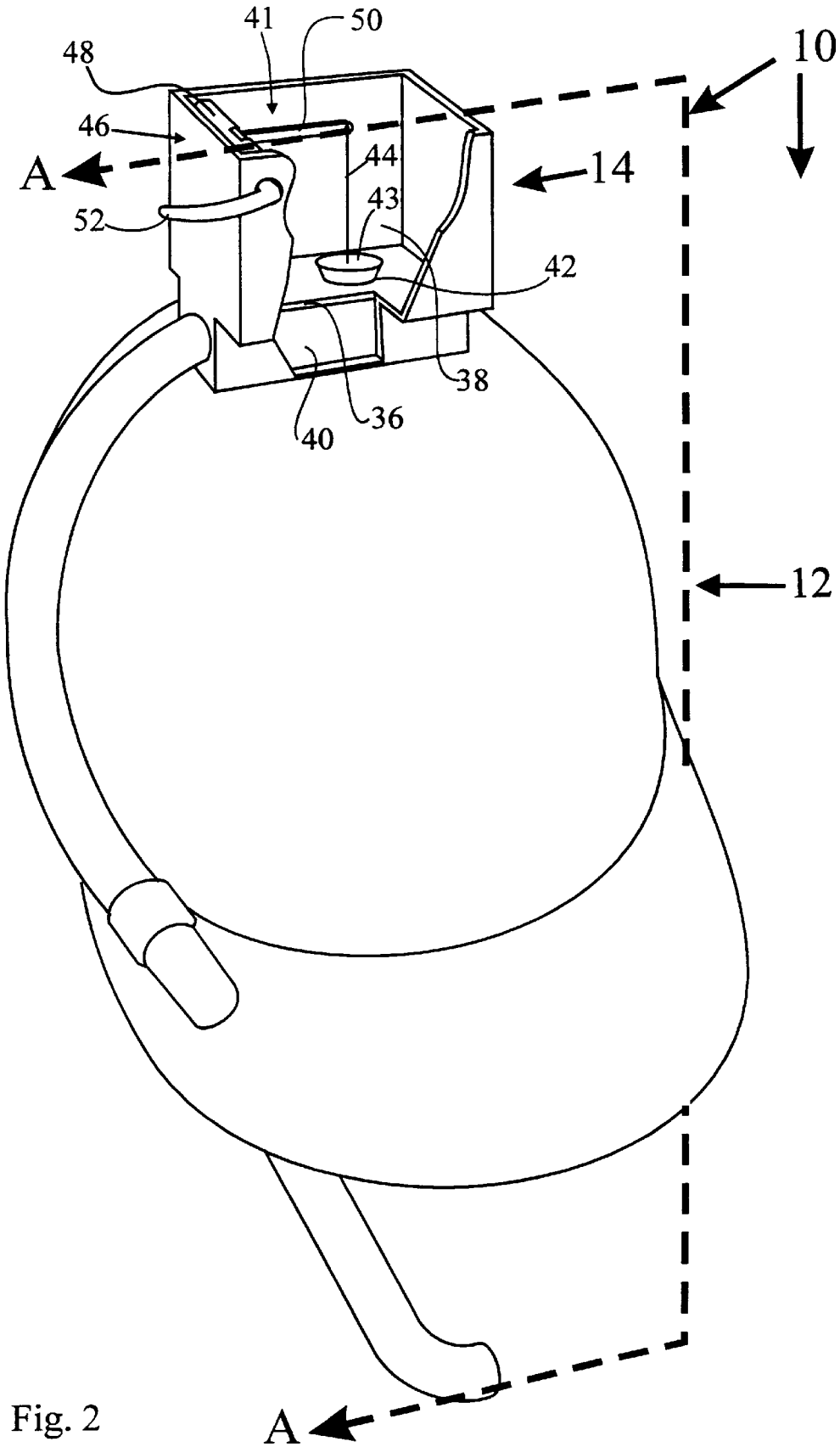
FIG. 2 is a front perspective broken away view of the first preferred embodiment of the invention described herein wherein the valve is in an open position.

As best shown in FIG. 2, in the first preferred embodiment of the invention described herein, said elevated reservoir 14 further comprises a dividing wall 36 which divides the interior of said elevated reservoir 14 into a fluid storage cavity or chamber 38 and fluid flow cavity or chamber 40. Said dividing wall 36 comprises an opening 42 (best shown in FIG. 3) which allows fluid to flow from said fluid storage cavity 38 to said fluid flow cavity 40.

Figure 3:
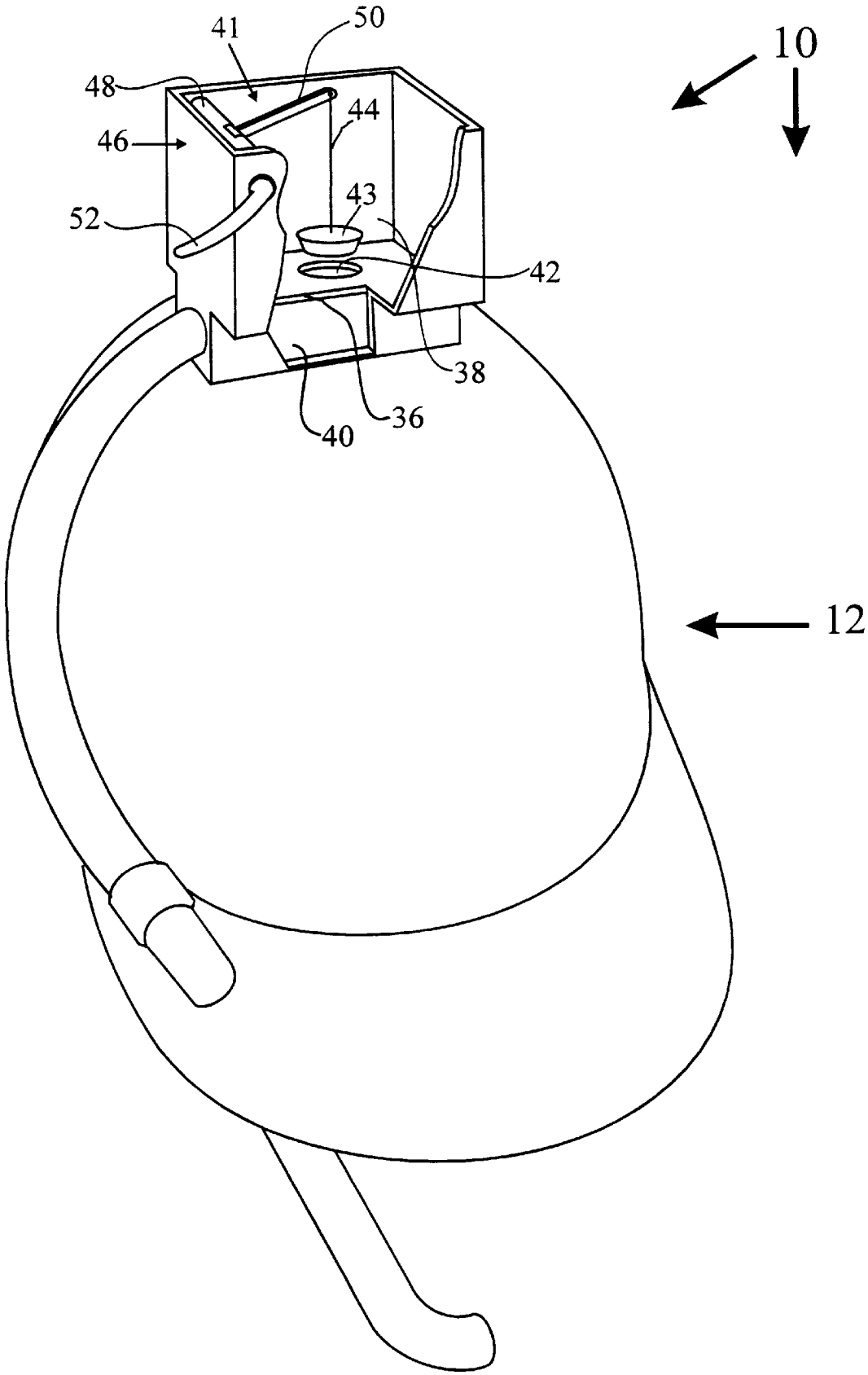
FIG. 3 is a front perspective broken away view of the first preferred embodiment of the invention described herein whether the valve is in a closed position.

The invention described herein further provides a valve means 41 for regulating the downward flow of liquid from said fluid storage cavity 38. In the first preferred embodiment of the invention illustrated in FIG. 2, said valve means 41 comprises a stopper 43 and stopper engaging mechanism 46. In the first preferred embodiment of the invention illustrated in FIG. 2, said stopper engaging mechanism 46 comprises tube 48 which is mounted on said side wall 30. Said stopper engaging mechanism 46 further comprises a stopper engaging arm 44 pivoting arm 50, lever 52 and rotating member (not shown) which is disposed within said tube 48. Said stopper engaging arm 46 pivoting arm 50, lever 52 and rotating member are connected and move together. Accordingly, when said lever 52 is manually depressed, said rotating member 54 rotates within said tube 48, thereby pivotally displacing said pivoting arm 50, thereby engaging said stopper engaging arm 44. Stopper 43 is thereby lifted from said opening 42, thereby permitting downward flow of said fluid from said fluid storage cavity 38 to said fluid flow cavity 40. The stopper also defines a valve member whereby the peripheral conical surface as shown by FIG. 3 is adapted to seat against the valve seat defined by the circumferential opening of hole 42 so as to act like a valve in a closed position shown in FIG. 2 to an open position shown in FIG. 3.

In operation of the first preferred embodiment of the invention described herein, a user places helmet shell 12 on his/her head. A fluid is introduced into said elevated reservoir 14 either before or after said helmet shell 12 is placed on his/her head by removing cover 22 and pouring said fluid into said fluid storage cavity 38. Top opening 20 is covered with cover 22. When the user wishes to dispense said fluid from said elevated reservoir 14, the user bends said outlet tube 15 so that said outlet tube 15 communicates with the user's mouth, as described above, and said lever 52 is depressed, thereby engaging stopper engaging arm 44 to lift stopper 43 from said opening 42, whereby gravitational force creates a downward flow of said fluid from said fluid storage cavity 38 to said fluid flow cavity 40, then through said outlet tube 15 to the mouth of the user. Once the user decides that the desired amount of fluid will soon have been dispensed, said lever 52 is released whereby said stopper 43 returns to said opening 42 so as to stop any further downward flow of said fluid through said opening 42 by operation of gravity.

It is possible that it some cases said stopper 43 will not return to said opening 42 once said lever 52 is released, particularly if said opening 42 is not substantially parallel the ground in the case of flat terrain. It is desirable therefore to provide said stopper 43 with means for ensuring that said stopper 43 locates said opening 42 whenever said lever 52 is released. For example, in a manner well-known to those skilled in the art, said stopper 43 may be provided with a hinge means (not shown) which hingedly attaches said stopper 43 (at a point which is adjacent to the circumference of said stopper 43) to the bottom wall of said fluid storage cavity 38 (at a point which is adjacent to said opening 42). Said hinge means permits said stopper chain 44 to lift said stopper 43 partially only so as to permit said downward flow of liquid through said opening 42 while maintaining said stopper 43 in place so as to ensure that upon said lever 52 being released, said stopper 43 seals said opening 42. In an alternate embodiment of the invention described herein, a chain could be used to replace said stopper engaging arm 44, in which case said hinge means would be necessary to ensure that in operation said stopper 43 refuses to seal opening 42 when said lever 52 has been released.

It should be understood that alternate valve means may be provided without departing from the scope of the invention described herein. For example, a circumferential tubing stop may be presented by said outlet tube 15 which may be manually engaged and disengaged as is well-known to those skilled in the art. In a further alternate embodiment of the invention described herein, said valve means may also comprise a standard solenoid valve controlled by an electronic circuit and switching means, as is also well-known to those skilled in the art. In such further embodiments of the present invention, wherein said valve means is presented by said outlet tube 15 rather than said elevated reservoir 14, said elevated reservoir would not comprise said dividing wall 36.

Various embodiments of the invention have now been described in detail. Since changes in and/or additions to the above-described best mode may be made without departing from the nature, spirit or scope of the invention, the invention is not to be limited to said details.

I claim:

1. A beverage dispensing device comprising:

(a) a reservoir for holding a beverage, slid reservoir further comprising:

(i) an opening for introducing said beverage into said reservoir; and (ii) outlet;

(b) dispensing means for dispensing said beverage from said reservoir, said dispensing means further comprising:

(i) a valve operably associated with said outlet, sad valve having a first close position and second open position;

(ii) valve activator for activating said valve from said first closed position to achieve said second open position; and outlet tube communicating with said outlet; and (c) head engaging support means associated with said reservoir and dispensing means for mounting said reservoir and dispensing means on the head of a user;

wherein said reservoir is elevated in relation to said outlet tube;

wherein said outlet is disposed substantially at the bottom of said reservoir;

wherein said valve is biased to said first closed position; and wherein a descending flow of said beverage is produced when said valve activator is engaged to activate said valve to achieve said second position, whereby said beverage is dispensed through said outlet tube.

2. A beverage dispensing device as claimed in claim 1, wherein said valve comprises a stopping means which seals said outlet in said first closed position.

3. A beverage dispensing device as claimed in claim 2, wherein said valve activator comprises a valve engaging means for engaging said stopping means in said first closed position to achieve said second open position.

4. A beverage dispensing device as claimed in claim 3, wherein said head engaging support means comprises a helmet.

5. A helmet and beverage dispensing apparatus comprising:

(a) a helmet shell;

(b) reservoir associated with said helmet shell for dispensing a beverage, said reservoir comprising:

(i) an opening for introducing said beverage into said reservoir; and (ii) outlet; and (c) dispensing means for dispensing said beverage from said reservoir, said dispensing means further comprising:

(i) a stopping means operably associated with said outlet, said stopping means having a first closed position and second open position;

(ii) means for engaging said stopping means in said closed position to achieve said second open position; and (iii) outlet tube communicating with said outlet;

wherein said reservoir further comprises a bottom wall, and said stopping means comprises a sealing member having a cross-section that is greater than the cross-section of said outlet when said stopping means is in said first closed position; and wherein said reservoir is mounted on said helmet shell in an elevated position in relation to said outlet tube, thereby producing a descending flow of said beverage when said means for engaging said stopping means is activated to engage said stopping means in said first closed position to achieve said second open position, thereby dispensing said beverage through said outlet tube.

6. A helmet and beverage dispensing apparatus as claimed in claim 5, wherein said stopping means is biased to said first closed position, whereby when said means for engaging said stopping means is not activated, said stopping means returns to said first closed position.

7. A helmet and beverage dispensing apparatus as claimed in claim 6, wherein said means for engaging said stopping means comprises:

(a) a lifting means operably associated with said stopping means for lifting said stopping means from said outlet when said stopping means is in said first closed position to achieve said second open position; and (b) engaging arm presented exteriorally by said reservoir, said engaging arm being operably associated with said lifting means and for exteriorally engaging said lifting means.

8. A helmet and beverage dispensing apparatus as claimed in claim 7, wherein said means for engaging said stopping means further comprises a locating means which is operably associated with said stopping means, and presents said stopping means with means for locating said outlet when said stopping means achieves said first closed position from said second open position when said means for engaging said stopping means is no longer activated.

9. A helmet and beverage dispensing apparatus as claimed in claim 8, wherein said locating means comprises a hinged member which hingedly connects said stopping means at one end to said bottom wall.

* * * * *